United States Patent [19]

Bertoli

[11] 4,355,498

[45] Oct. 26, 1982

[54] DEVICE FOR SPLICING TEXTILE YARNS WITH THE AID OF COMPRESSED AIR

[75] Inventor: Luciano Bertoli, Salo', Italy

[73] Assignee: Mesdan S.p.A., Brescia, Italy

[21] Appl. No.: 272,728

[22] Filed: Jun. 11, 1981

[30] Foreign Application Priority Data

Jun. 13, 1980 [IT] Italy ..... 22768 A/80

[51] Int. Cl.[3] ..... B65H 69/06; D02J 1/08

[52] U.S. Cl. ..... 57/22

[58] Field of Search ..... 57/22, 23, 261, 263, 57/350; 28/271-274

[56] References Cited

U.S. PATENT DOCUMENTS

| | | | |
|---|---|---|---|
| 3,561,502 | 2/1971 | Swaisgood | 57/22 X |
| 3,581,486 | 6/1971 | Dibble | 57/22 |
| 3,633,352 | 1/1972 | Marriner | 57/22 |
| 3,668,852 | 6/1972 | Fusco et al. | 57/22 |
| 3,822,538 | 7/1974 | Cardell | 57/22 |
| 4,217,749 | 8/1980 | Rohner et al. | 57/261 |
| 4,232,508 | 11/1980 | Husges et al. | 57/22 |

*Primary Examiner*—John Petrakes

*Attorney, Agent, or Firm*—Lackenbach, Siegel, Marzullo, Presta & Aronson

[57] ABSTRACT

In a device for splicing textile yarns by fibre-intermingling with the aid of compressed air, a pneumatic timing unit is provided for adjusting the duration of the compressed air jet. The unit essentially comprises a timing reservoir composed by a number of spaces interconnected with each other and communicating with the fibre-blending chamber, a cutoff valve controlling the flow of air from the air source to the blending chamber. An auxiliary throttling means permits to adjust with the desired accuracy the flow of compressed air from the timing reservoir to the blending chamber, so that it becomes possible to select the proper time of jet duration according to the yarn types.

6 Claims, 6 Drawing Figures

DEVICE FOR SPLICING TEXTILE YARNS WITH THE AID OF COMPRESSED AIR

This invention relates to a device for splicing textile yarns by admixing and intermingling their fibres with the aid of compressed air.

In the textile art knotting machines are known, which are adapted to unite two yarns by the formation of a knot. These jointing knots originate disturbances during progress of the further processing of the yarns on the textile machines, since they are points at which the even continuity of the yarn is discontinued.

In order to offset such a shortcoming, systems and devices have already been suggested, which are capable of splicing textile yarns without knotting them together and a few of said devices do so by admixing and intermingling the fibers with the aid of compressed air.

Such devices substantially comprise a blending chamber having an appropriate outline and which can be closed frontally, or not, by a lid or a cover, the ends of the two yarns to be spliced being positioned in said chamber into which a compressed air outlet port opens, wherethrough a jet or a blow of compressed air can be introduced during a preselected period of time into the blending chamber so as to bring about the intertwining and the intermingling of the fibers of the two yarns concerned so that they become permanently fastened together.

This fiber intermingling and intertwining run in the interior of the blending chamber under the blow of the air jet takes place, it is surmised, in two sequential steps: during the first step, under the abrupt pulse of the air blow, the fibers of the yarn tend to spurt apart from each other so that the original twist is temporarily and partially destroyed, whereas, in the second stage, the fibers are already spread apart and thus are in a condition which is ideal for becoming blended and intertwined all together under the effect of the whirling motion of the air in the blending chamber; the original twist then tends to become partially restored by a helical motion of the fibers and this fact contributes towards improving the blending and thus the quality of the splicing of the two textile yarns. Quite understandably, these two stages are immediately consecutive relative to one another and no sharp demarcation line can be drawn therebetween.

In the actual practice of this method of splicing by blending and intermingling of the component fibers of yarns, it has been ascertained that both good results and reproducibily are a function of a number of factors which are not easily determined. As a matter of fact, the process can be controlled only with difficulty and to a reduced degree and these difficulties are still aggravated by the requirement of having a device available, which can be exploited not only for a certain type of textile yarns, but can be used for the knotless splicing of yarns having different characteristics both in terms of count of yarn and intrinsic properties of the component fibers thereof.

The technical problem that the present invention aims to solve is thus to provide a device for splicing textile yarns without knotting them, which is capable of obtaining a consistent and reliable union also with yarns having different properties, and which can be adapted to the various requirements by simple regulation operations, so that a high degree of reliability and safety is thereby achieved.

In an endeavor towards solving such a problem, it has been seen through accurate study and trials, that the splicing process and the results which can be achieved are, to a degree, a function of the mode of action of the air blow within the blending chamber.

This mode of action is intimately connected with the time of duration of the action of the air blow as well as with the rapidity with which the air can display its effect within the blending chamber.

The duration of the action of the air blow has proven to be extremely critical, and varies consistently with the characteristics of the yarns to be spliced. The instantaneousness of the action is a prerequisite to the end of a successful outcome of the splicing procedure.

In the conventional devices used heretofore for manual use by an operator, the duration of the action of the air blow was established quite empirically at the operator's choice so that the results which could be obtained were, to a degree, a function of the capability and the experience of the operator concerned. It should be borne in mind that it is not enough to establish, for each type of yarn, a certain minimum time of action of the air blow, but it is also necessary to cut the maximum time at an optimum value.

As a matter of fact, it might have been surmised that only the minimum blowing time is critical, while the maximum time could have been selected at the free choice of the operator, but, contrary to expectations, it has been found that it is likewise important to limit the duration of the blow to the strictly necessary time without unduly extending it beyond that value.

The present invention solves the problem aimed at by a device which comprises a blending chamber having a substantially V-shaped cross-sectional outline and having a part opening centrally through its bottom wall and connected through a cutoff valve to a source of compressed air, a lid for closing said chamber frontally, means for shifting said lid from an inoperative position away of said chamber to a position of closure of said chamber and vice versa, means synchronized with said lift-shifting means to open said valve as the lid is in its closed position, and members for positioning and introducing the yarns to be spliced in the blending chamber and for severing the free ends thereof, said members being controllable synchronously with the motion of said lid from its inoperative position to the position of closure of the blending chamber, the device being characterized in that it is comprised of a pneumatic control unit having an air intake duct connected to a source of compressed air and an air outlet duct in direct communication with said port opening into the blending chamber, said air intake duct communicating with the outlet duct through a channel in which said cutoff valve controllable by said means synchronized with said lidshifting means is inserted serially with a second cutoff member, there being formed in the pneumatic control unit a timing reservoir connected through a passageway to a point, downstream of said second cutoff member, of said communication channel, said reservoir having at least one wall shiftable against the bias of resilient means and carrying said second cutoff member.

It is an advantage to insert in said passageway connecting the timing reservoir to the communication channel an adjustable throttling member in order to be able to vary the filling time of the reservoir and also the time which is required for establishing therein the pressure which is necessary for shifting said movable wall and the second cutoff member against the bias of the resilient means.

It is particularly advantageous to arrange the cutoff valve and the second cutoff member in the vicinity of said outlet duct for the compressed air while reducing the length of such duct to a minimum: by so doing, in fact, when said valve is opened, the compressed air arrives jetwise and virtually instantaneously at the blending chamber so that its gradual action is prevented which would otherwise originate phenomena of ejection of filaments out of the chamber. In addition, this approach ensures that the yarns to be spliced are reliably in the desired position within the chamber, as obtained by means of the introduction members, at the instant of time in which they are subjected to the maximum stress by the air jet.

Quite appropriately, the shiftable wall of the timing reservoir consists of a piston to which the second cutoff member is integrally united.

For discharging the air from the timing reservoir on completion of each working cycle, there is provided a passageway which can properly be controlled by the stem of the cutoff valve and which leads to the outside through an axial bore formed through said stem and through perforations formed through the stem head.

This discharged air can serve with advantage as a cleanup air for the mechanical component parts of the device for freeing the machine from fiber residues after each working cycle.

The device according to this invention will be described in more detail hereinafter with reference to the accompanying drawings, wherein.

Figure 1:
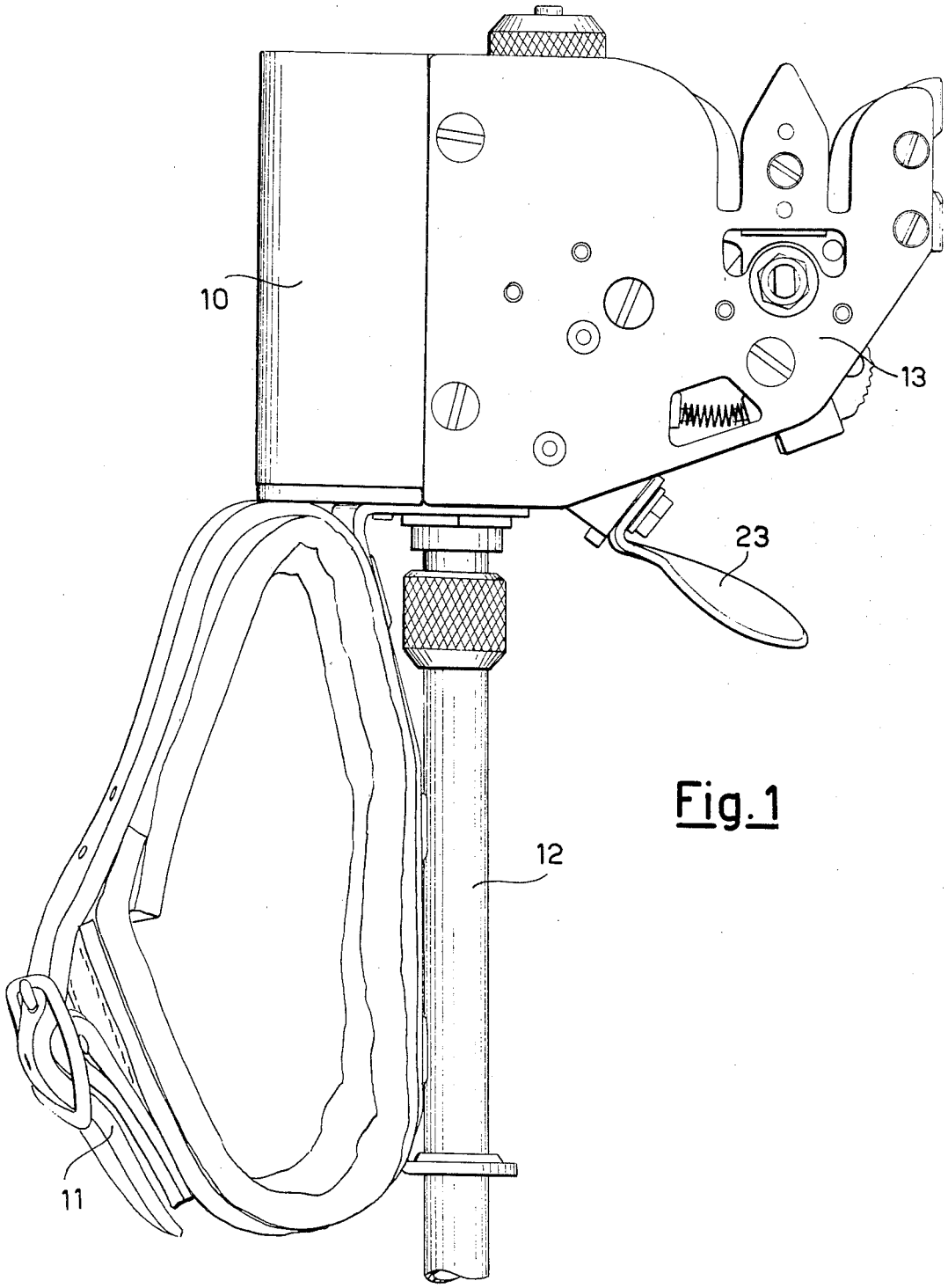
FIG. 1 is a side elevational view of the device.
Figure 2:
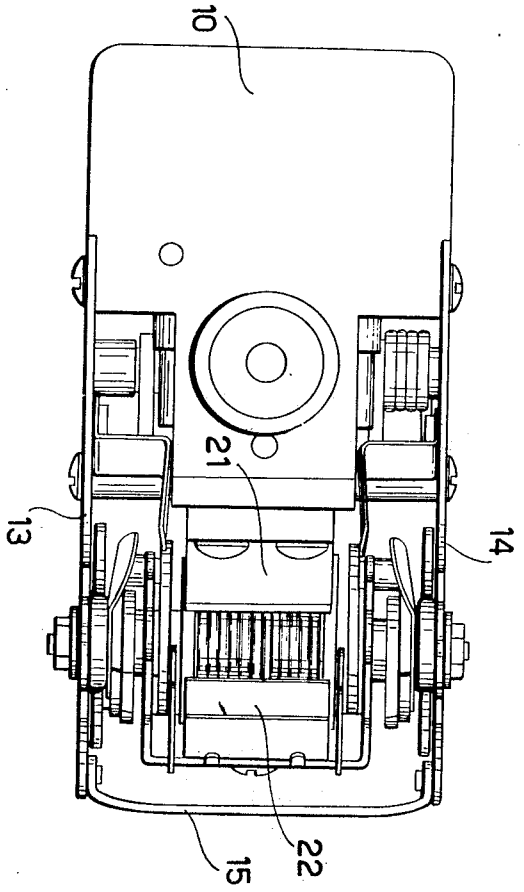
FIG. 2 is a top plan view of the device.

FIGURES from 3 to 6 inclusive show in cross-sectional view a several sequential working stages.

The device shown in the drawings is of the kind which can manually be controlled by a trigger and is intended to be worn on the hand of an operator. The device comprises a main body 10 which houses the pneumatic control unit that is the subject matter of this invention. The body 10 has a strap 11 for hand wearing and a tube 12 to be connected to a compressed air source (not shown). To the body 10 there are secured two sidewalls 13, 14 held together by a shielding stirrup 15 and between these sidewalls there is mounted the mechanical unit which is not of interest for the present invention and thus is not described in detail herein. A possible embodiment of this mechanical unit is the subject matter of a copending patent application by the same Applicant hereof.

It can be seen that the device comprises a blending chamber 20 shaped as a block 21 centrally secured to the main body 10, and a lid 22 mounted for being swung between the sidewalls 13, 14 and controllable by a trigger 23 for being shifted from an inoperative position to a position of front closure of the blending chamber 20. The trigger 23 is functionally connected to a pressor member 24 which is adapted to actuate a cutoff valve, as will be described in more detail hereinafter.

Through the body 10 an inlet duct 25 for compressed air is formed, to which the tube 12 is connected. In addition, an outlet duct 26 is provided which directly communicates with a central port 27 which opens into the blending chamber 20 in correspondence with the bottom wall thereof. The inlet duct 25 communicates with the outlet duct 26 via a channel 28.

In the channel 28 a seat 29 is formed for the body 30 of a cutoff valve, said body being fastened to a stem which extends, with a section 31 along a direction and with a second section 32 in the opposite direction. This twin-section stem can be shifted axially and is appropriately guided in a sealtight manner.

The entire stem 31-32 has an axial bore therethrough, 33, which also goes through the valve body 30 and which is extended from the free end of the section 32 up to a knob-shaped head 34 of the section 31, in correspondence with which the bore 33 opens into the outside atmosphere through an array of substantially radial perforations 35.

Figure 3:
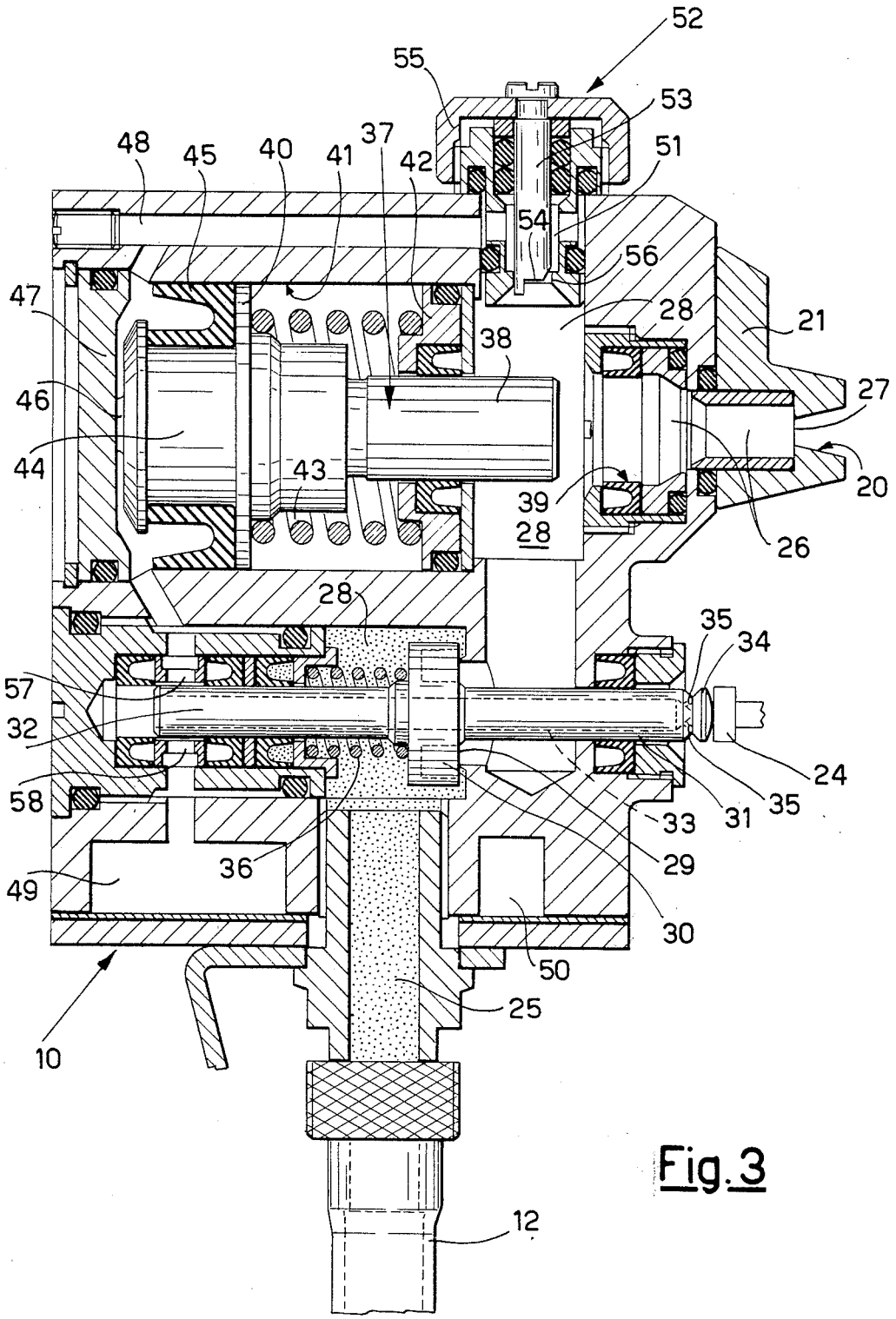

The knob head 34, when the valve body 30 is pressed against its seat 29 by a spring 36, slightly juts out of the main body 10 (best seen in FIG. 3).

Downstream of the cutoff valve 30 and in the communication channel 28 there is arranged a second cutoff member, generally indicated at 37, which is comprised of a cylindrical body 38, axially displaceable, and intended to enter in a sealtight manner into a seat 39 at the initial portion of the outlet duct 26 to close the latter. The cylindrical body 38 is integral with a movable wall 40 which can be shifted in a sealtight manner within a cylindrical space 41 formed through the main body 10. Between said movable wall 40 and a fixed wall 42, which closes the space 41 in a sealtight manner towards the channel 28, a spring 43 is active, which maintains the movable wall 40 and the cylindrical body 38 in the inoperative position shown in FIG. 3, wherein the body 38 is kept away of the seat 39 and thus allows air to flow into the outlet duct 26.

On the opposite side of the cylindrical body 38 the movable wall 40 carries a piston 44 surrounded by a gasket 45 and having a front protrusion 46 acting a spacer between the wall 47 and the volume 41 opposite to the wall 42.

The space 41, on the side where the piston 44 is located, forms, together with other spaces 48, 49 and 50 in the main body 10, said spaces being all connected together (partly by a passageways not shown in the drawings), a timing reservoir having a preselected volume which can be increased by shifting the movable wall 40 against the bias of the spring 43.

This timing reservoir 41, 48, 49 and 50, communicates via a passageway 51 with a point of the channel 28 which is downstream of the cutoff member 37, and, exactly, branched off from the communication of the channel 28 towards the outlet duct 26. Within the passageway 51 there is inserted an adjustable throttling member, generally indicated at 52, which is comprised of dowel 53 having a shaped distal end 54 and a ferrule 55 which carries the dowel 53. The shaped end 54 of the dowel 53 cooperates with a seat 56, so that, by lifting the dowel 53 to a higher or a lower level by rotating the ferrule 55, it is possible to change the free flow passage area from a minimum value to a maximum one. By this regulation it becomes possible to vary the time which is necessary for filling the reservoir 41, 48, 49 and 50 with air coming from the channel 28 and thus the time required for establishing within the reservoir the pressure which is necessary for shifting the movable wall 40 and the associated cutoff member 37 against the bias of the spring 43, in order to insert the cylindrical body 38 into the seat 39 and thus to cutoff the flow of air from the channel 28 to the outlet duct 26.

It is worth noting that the channel 28 which establishes a communication between the inlet duct 25 and the outlet duct 26 has a wide cross-section and that the cutoff valve 30 and the cutoff member 37 are very close to the outlet duct 26, the latter having a comparatively reduced length, so that, as the valve 30 is opened, the air jet immediately reaches the blending chamber 20, whereas, as the member 37 is closed, the action of the air in said chamber is instantaneously interrupted.

Figure 4:
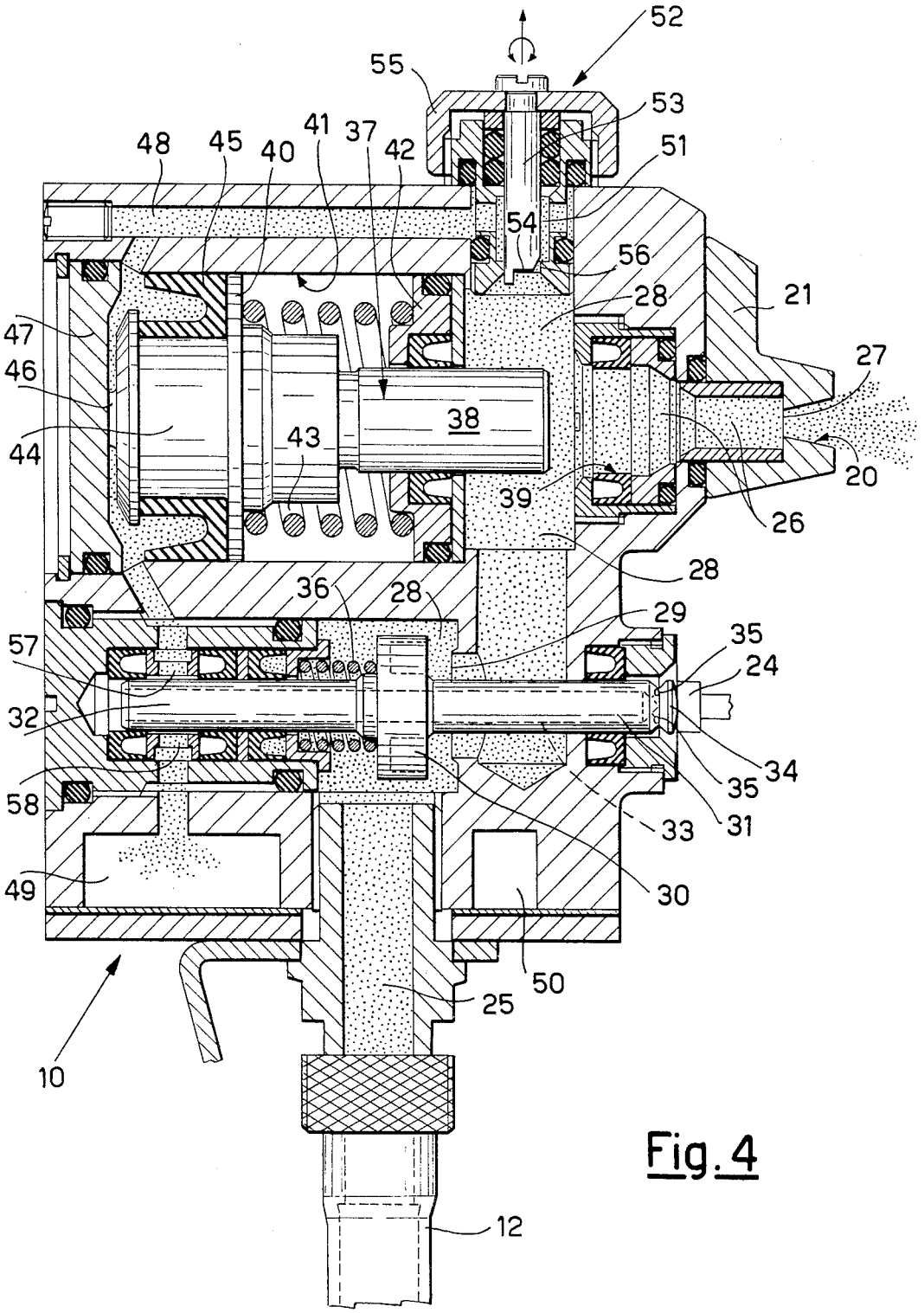
Figure 5:
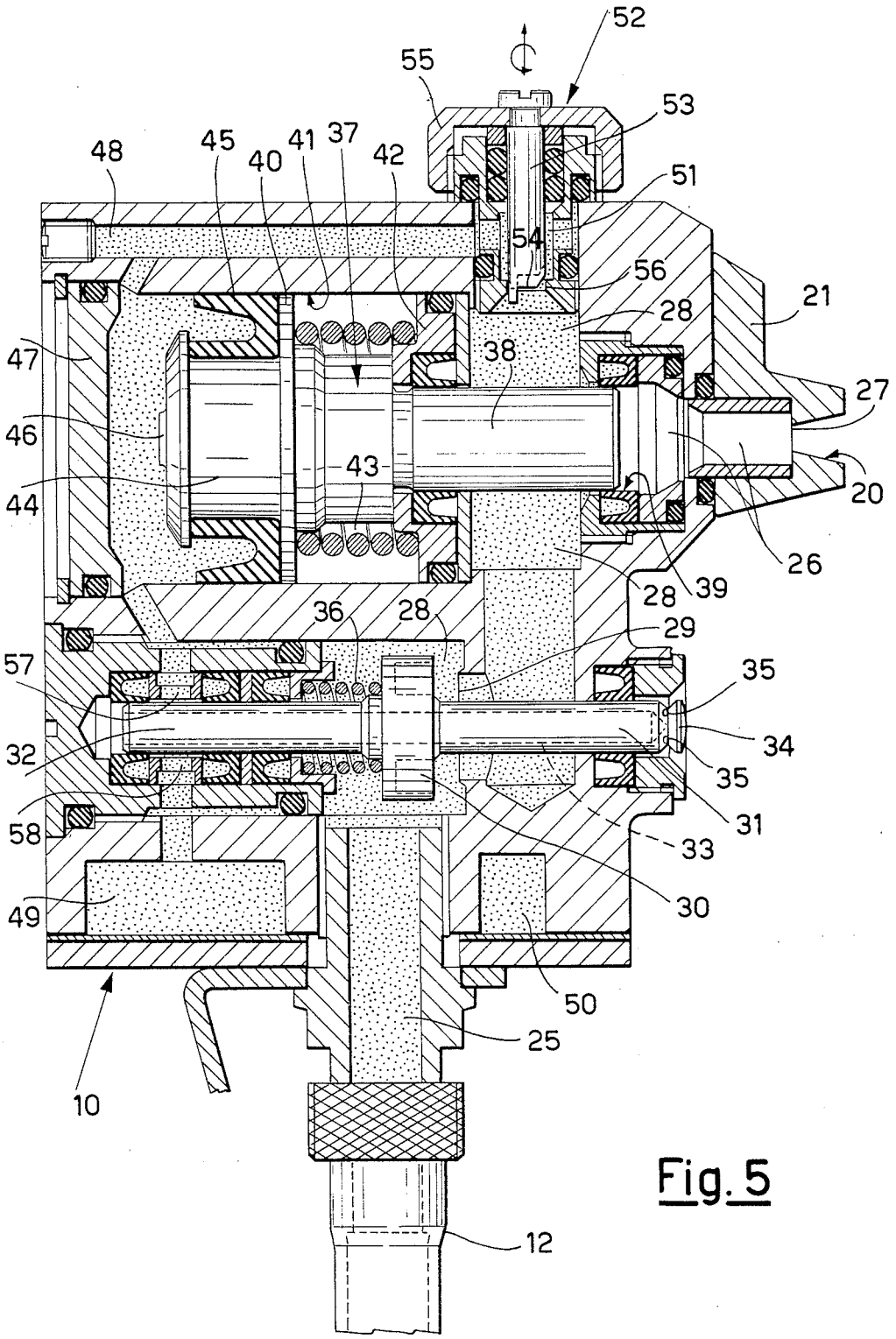
Figure 6:
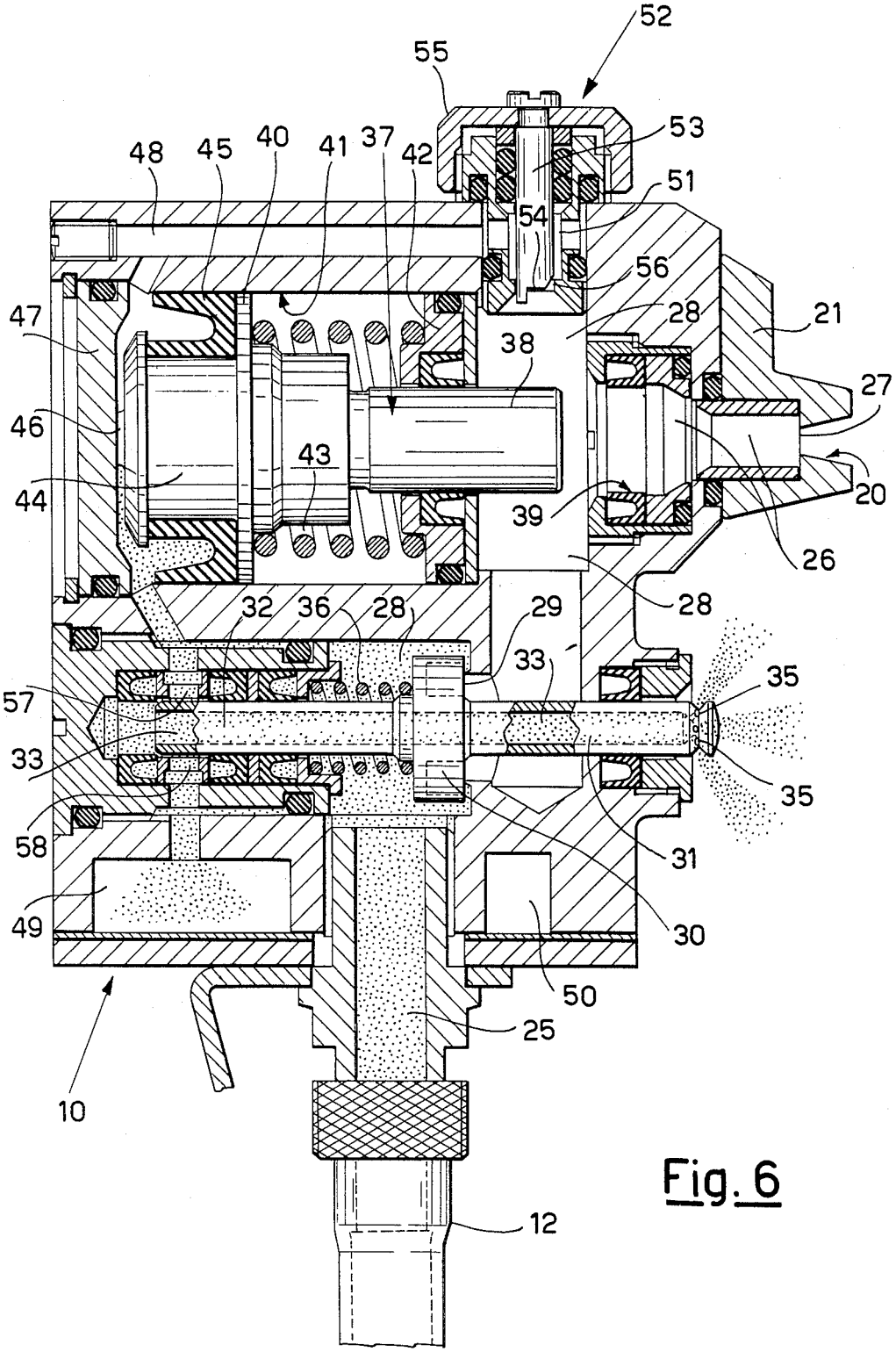

The stem section 32 of the cutoff valve 30 has the function of a slide valve controlling a discharge duct for air from the reservoir 41, 48, 49, 50. As a matter of fact, the distal end of the stem section 32 cooperates with lateral perforations 57, 58 which communicate with the several volumes of the reservoir and when the cutoff valve 30 is in its closed position (FIGS. 3 and 6) a passageway for air is provided just through said lateral perforations 57, 58 towards the bore 33 formed axially throughout the stem 31, 32. When the cutoff valve 30 is open (FIGS. 4 and 5), this passageway, conversely, is intercepted.

The operability of the pneumatic control unit is thus as follows.

In the inoperative position (FIG. 3) the cutoff valve 30 is closed and the cutoff member 37 allows a free flow from the channel 28 to the outlet duct 26. The compressed air coming from the tube 12 into the inlet duct 25 is thus arrested in the portion of the channel 28 upstream of the valve 30.

When, after positioning the two yarns to be spliced in the blending chamber 20, the presser 24 is actuated by the trigger 23 to bear against the head 34 of the stem 31-32 of the valve 30 against the bias of the spring 36, the valve 30 is opened (best seen in FIG. 4) and the compressed air reaches virtually instantaneously, through the channel 28 and the outlet duct 26, the chamber 20 to carry out the splicing operation. Simultaneously, the air flows through the passageway 51 and reaches the several spaces of the timing reservoir.

It should be borne in mind that, under these circumstances, the discharge duct of the reservoir is closed because the discharge bores 57, 58 are plugged by the end of the stem section 32 of the valve 30.

The time which is required for filling the reservoir and establishing therein such a pressure as to overcome the bias of the spring 43 (which must properly be calibrated) and thus to shift the movable wall 40 and the cutoff member 37 associated therewith, is a function of the regulation of the throttling member 52. By shifting the member 37, its cylindrical body 38 becomes inserted into the seat 39 and thus it cuts off the air flow in the outlet duct 26 and the blending chamber 20 (see FIG. 5).

It has been ascertained, in practice, that the duration of the air jet in the chamber 20 can properly be varied from a few hundredths of a second to a few tenths of a second. In a field-tested embodiment of the device having a pneumatic control system according to this invention, it is possible to obtain, by adjusting the throttling member 52, jet durations of from 0.04 second to 0.8 second.

On completion of a working cycle, as the presser 24 is released, the spring 36 brings back the cutoff valve 30 to the closed position (FIG. 6) and its stem section 32 clears the bores 57, 58, so that the air can be discharged from the reservoir 41, 48, 49 and 50, through the axial bore 33 of the stem 31, 32 and through the perforations 35 of the stem head 34. This perforations 35 are appropriately oriented so as to clear the device from residues of fibrils which may have been accumulated during operation.

As the air is being discharged from the reservoir 41, 48, 49 and 50, the pressure therein is decreased and the spring 43 can restore the movable wall 40 and its associated cutoff member 37 to the starting position.

The timing of the air jet introduced into the blending chamber guarantees the accurate repeatability of the splicing process.

The adjustment of the duration of the jet permits to adapt the device to the splicing of yarns having different characteristics.

In a rule-of-thumb way, it can be said that yarns having a short and soft fibre structure require shorter times, whereas yarns having a long and coarse fibre structure require longer times. Too long a duration of the jet on yarns having a short and soft fibre structure may originate an undesirable weakening of the fibres, whereas too short times in the case of yarns having a long and coarse fibre structure could not afford to ensure a satisfactory blending.

The timing of the jet by exploiting the same compressed air which provides the jet and with a timing reservoir incorporated in the main body of the device as provided by the invention has permitted that an apparatus may have been obtained which is lightweight and handy so that the manual use is facilitated, and is also compact, so that the device lends itself well also to the use with a mechanical control, for example in the narrow space available on the automatic spoolers.

In addition, the proximity of the points at which the jet is cut off to the blending chamber improves the result of the blending considerably because the start of the process is virtually instantaneous with an immediate fibre interlock, even if only partially instead of gradually: this fact reduces the phenomena of ejection of the yarns from the blending chamber and ensures that the yarns stay surely in the desired position as obtained with the yarn introduction means, at the instant in which they undergo the maximum strain.

Splicing can be obtained within the preselected very short times without having to rely on the skill and experience of the individual operators.

As outlined above, the invention is not only applicable to manually controlled machines, but also to those having a mechanical, electromechanical control or any other kind of control.

I claim:

1. A device for splicing textile yarns by admixing and intermingling their component fibers with the aid of compressed air, which comprises a blending chamber having a substantially V-shaped cross-sectional outline and having a port opening centrally through its bottom wall and connected through a cutoff valve to a source of compressed air, a lid for closing said chamber frontally means for shifting said lid from an inoperative position away of said chamber to a position of closure of said chamber and vice versa, means synchronized with said lid-shifting means to open said valve as the lid is in its closed position, and members for positioning and introducing the yarns to be spliced in the blending chamber and for severing the free ends thereof, said members being controllable synchronously with the motion of said lid from its inoperative position to the position of closure of the blending chamber, the device being characterized in that it is comprised of a pneumatic control unit having an air intake duct connected to a source of compressed air and an air outlet duct in direct communication with said port opening into the blending chamber, said air intake duct communicating with the outlet duct through a channel in which said cutoff valve controllable by said means synchronized with said lid-shifting means is inserted serially with a second cutoff member, there being formed in the pneumatic control unit a timing reservoir connected through a passageway to a point, downstream of said second cutoff members, of said communication channel, said reservoir having at least one wall shiftable against the bias of resilient means and carrying said second cutoff member.

2. Device according to claim 1, characterized in that in the passage-way connecting the timing reservoir to the communication channel, a throttling member is inserted, having an adjustable flow passage throttling member.

3. Device according to claim 1, characterized in that the cutoff valve and the second cutoff member are arranged in the vicinity of the port opening into the blending chamber.

4. Device according to claim 1, characterized in that the movable wall of the timing reservoir consists of a piston having integral therewith a cylindrical body forming the second cutoff member, said cylindrical body being intended to cooperate with a seat formed at the beginning of the outlet duct.

5. Device according to claim 1, characterized in that a discharge passageway is provided for the timing reservoir, said passageway being controllable by the cutoff valve stem.

6. Device according to claim 5, characterized in that the cutoff valve stem has an axial through-bore which, in correspondence with a stem head whereon the means synchronized with the lid-shifting means are active, opens into the outside atmosphere through substantially radial perforations, whereas in correspondence with the opposite stem end said axial through-bore is in communication with the discharge passageway of the reservoir when the cutoff valve is in its closed position.

* * * * *